US008489000B2

(12) United States Patent
Kawaguchi

(10) Patent No.: US 8,489,000 B2
(45) Date of Patent: Jul. 16, 2013

(54) DEVELOPING APPARATUS FOR AN IMAGE FORMING APPARATUS

(75) Inventor: Daisuke Kawaguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 12/827,672

(22) Filed: Jun. 30, 2010

(65) Prior Publication Data

US 2011/0013944 A1 Jan. 20, 2011

(30) Foreign Application Priority Data

Jul. 17, 2009 (JP) ..... 2009-168987

(51) Int. Cl.
*G03G 15/08* (2006.01)

(52) U.S. Cl.
USPC ..... 399/257; 399/88; 399/254

(58) Field of Classification Search
USPC ..... 399/257, 254, 256, 88, 119
See application file for complete search history.

(56) References Cited

U.S. PATENT DOCUMENTS 5,355,199 A * 10/1994 Bray ..... 399/256
6,587,661 B1 * 7/2003 Shimmura et al. ..... 399/257
2007/0269235 A1 * 11/2007 Hirose ..... 399/254

FOREIGN PATENT DOCUMENTS

JP 2-21591 B 5/1990
JP 2005-208338 A 8/2005

* cited by examiner

*Primary Examiner* — Sophia S Chen
(74) *Attorney, Agent, or Firm* — Canon USA, Inc., IP Division

(57) ABSTRACT

A developing apparatus includes a developer container to store a developer, a conveyance member to convey the developer, and a discharge port to discharge the developer. The discharge port is at a position that is on one end side from a central portion of the conveyance member with respect to an axial direction of the conveyance member. A first region of the conveyance member may include a portion facing the discharge port that has a conveyance capacity that is lower than a conveyance capacity of a second region or has a conveyance capacity that is zero. The conveyance member includes a positioning unit that is provided on the one end side thereof in the axial direction to position the conveyance member in the axial direction by abutting on the developer container, and an urging unit to urge the positioning unit with respect to the developer container.

4 Claims, 9 Drawing Sheets

DEVELOPING APPARATUS FOR AN IMAGE FORMING APPARATUS

BACKGROUND OF THE INVENTION

1. Field of the Invention

The present invention relates to a developing apparatus used in an image forming apparatus. The image forming apparatus utilizes an electrophotographic process or an electrostatic recording process, such as a copying machine, a printer, or a facsimile apparatus. The present invention also relates to an image forming apparatus equipped with the developing apparatus. More specifically, the present invention relates to a developing apparatus that uses a two-component developer including a toner and a carrier, and an image forming apparatus equipped with the same.

2. Description of the Related Art

Conventionally, in an image forming apparatus utilizing, for example, an electrophotographic process, a developing apparatus performing development with a two-component developer having a mixture including a toner and a carrier is widely used. In particular, from the viewpoint of image color tint, etc., many developing apparatuses for color image forming apparatuses use a two-component developer.

In a developing apparatus using a two-component developer, a toner is consumed through a developing operation, and a new toner is supplied in an amount corresponding to a consumption amount. On the other hand, a carrier remains in a developer container (developer vessel) without being consumed. Thus, the carrier, which is agitated together with the toner, is deteriorated through agitation. Deterioration of the carrier occurs when the toner adheres to a carrier surface layer. The toner adheres to a carrier surface layer typically as a result of friction when the developer is agitated and compression at the time of passing through a gap between a developer bearing member (such as a developing roller) provided in the developer container and a developer layer thickness regulating member (such as a regulating blade). When the carrier deteriorates, charging performance of the developer deteriorates. This results in deterioration in developing performance, which leads to generation of defective images. Therefore, the carrier is periodically replaced.

Replacement of the carrier is performed in the following manner. The developer is extracted via a developer extraction port provided in the developer container, and the developing apparatus is filled with a new developer. During the replacement, the toner, which is a powder, may be scattered, and soils the image forming apparatus and the periphery thereof.

In this regard, Japanese Patent Publication No. 2-21591 discusses a developing apparatus that suppresses deterioration of a developer, so that there is no need to perform a special developer replacing operation. Such a developing apparatus adopts a system generally referred to as a trickling system. In the trickling system, a discharge port is provided at a predetermined height on a housing side wall of the developing apparatus. To maintain a property of the developer at a fixed level, the discharge port in the developing apparatus is utilized to successively discharge an excess developer in the developing apparatus, which results from the supply of a developer including a toner and a carrier.

More specifically, in this method, an amount of the developer in the developer container increases due to the supply and any excess developer corresponding to an amount over a height of the discharge port overflows and is discharged from the discharge port.

However, in the trickling system, a conveyance member provided at a position facing the developer discharge port splashes the developer, with the result that the developer is discharged to an unnecessary degree.

Japanese Patent Application Laid-Open No. 2005-208338 discusses a developing apparatus has a configuration in which a cutout is provided in a screw of a conveyance and agitating member at a portion thereof facing a developer discharge port. According to this configuration, the developer is not easily affected by a splashing effect of the screw, and the developer can be discharged in a stable manner.

However, in the configuration in which the cutout is provided in the screw facing the developer discharge port or in the vicinity thereof as in the developing apparatus discussed in Japanese Patent Application Laid-Open No. 2005-208338, the following problem is involved. Usually, taking into account manufacturing variation in components and thermal deformation thereof, the developer container and the conveyance member are incorporated in the apparatus with some play. As a result, a relative position between the conveyance member and the developer container may vary within a range of the above described play. Due to the variation corresponding to the above described play, variation in positions of the cutout of the screw and of the developer discharge port in an axial direction may be generated. When such variation is generated, the discharge characteristics will fluctuate from apparatus to apparatus.

SUMMARY OF THE INVENTION

According to an aspect of the present invention, a developing apparatus includes a developer container to store a developer, a conveyance member to convey the developer, and a discharge port to discharge the developer. The discharge port is provided on the developer container at a position on one end side from a central portion of the conveyance member with respect to an axial direction of the conveyance member and facing the conveyance member. The conveyance member is configured such that a region including at least a facing portion facing the discharge port has a conveyance capacity lower than a conveyance capacity of a region adjacent to the region, or that the conveyance capacity of the region is zero. The conveyance member includes a positioning unit that is provided on the one end side thereof in the axial direction to position the conveyance member in the axial direction by abutting on the developer container, and an urging unit to urge the positioning unit with respect to the developer container.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. It is to be noted that dimensions, materials, configuration, positional relationship, etc. of components of a developing apparatus described in the embodiments and examples should not be construed restrictively limiting the scope of the present invention thereto unless otherwise specified.

Figure 2:
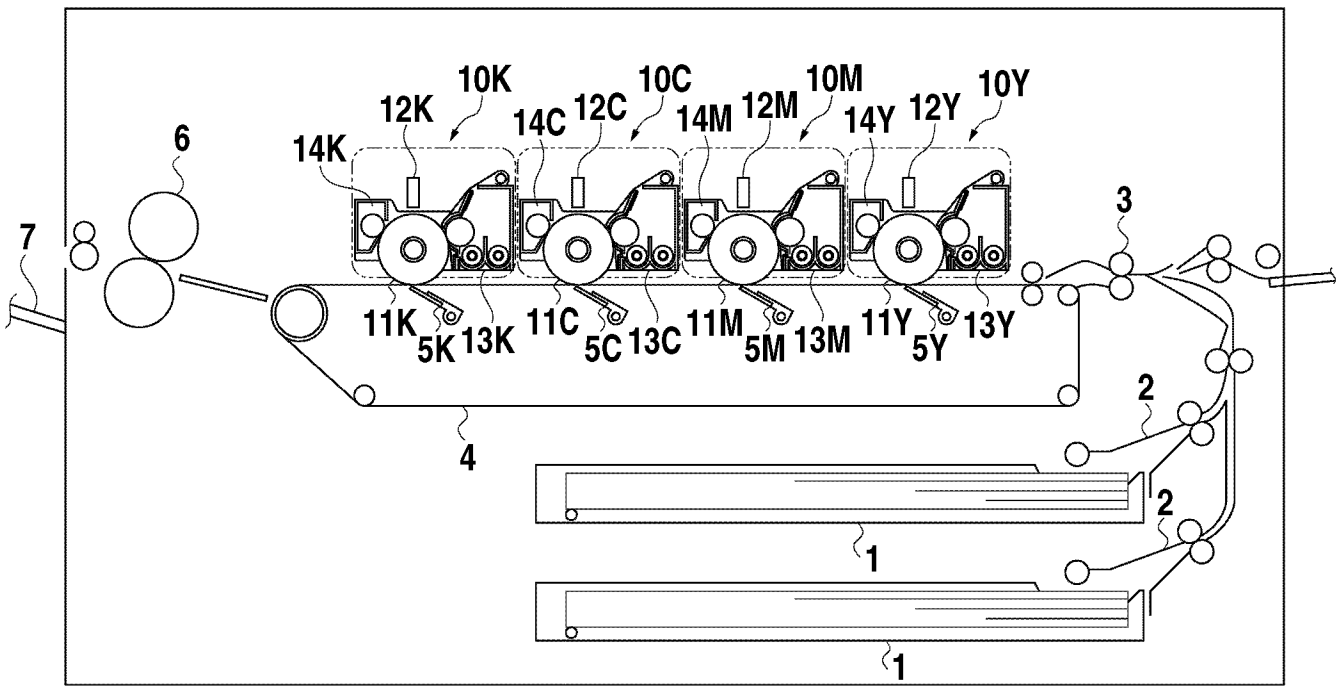
FIG. 2 is a cross sectional view of an image forming apparatus (full color copying machine) according to the present invention.

FIG. 2 is a cross sectional view of a full color copying machine as an image forming apparatus according to a first exemplary embodiment of the present invention. This full color copying machine is an apparatus that forms a full color image by superimposing one toner upon other toners of the four colors of yellow, magenta, cyan, and black.

Figure 3:
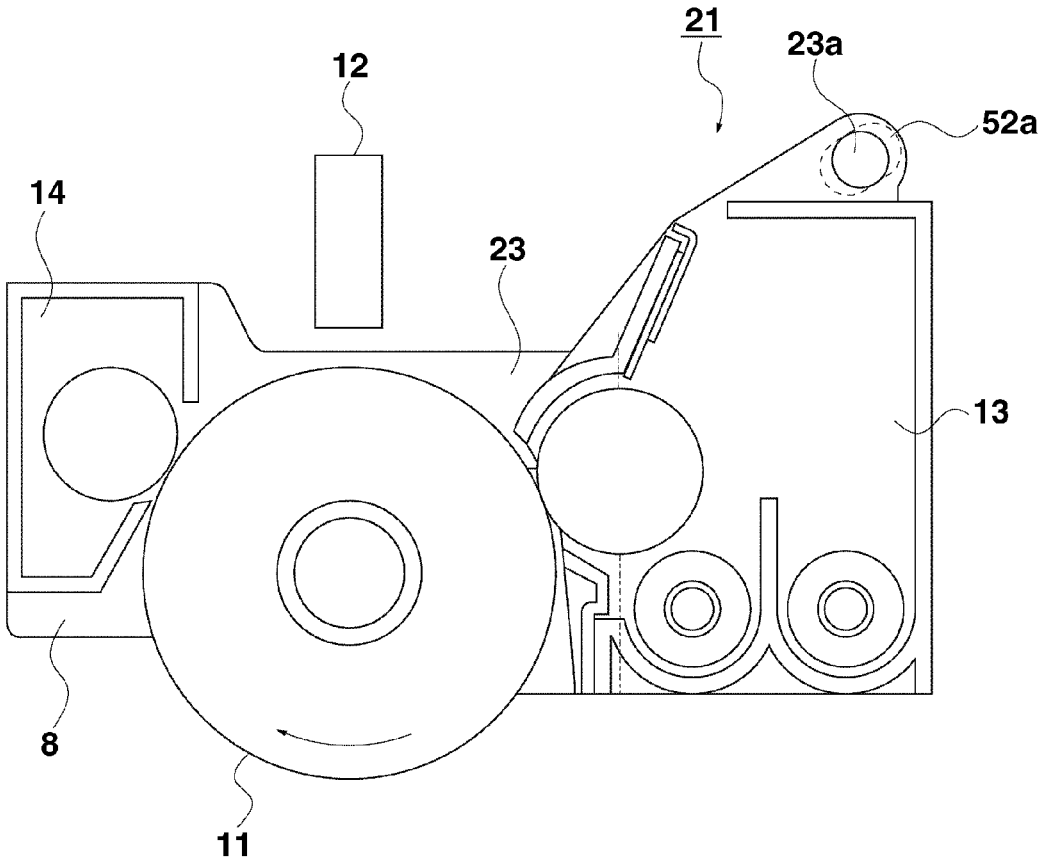
FIG. 3 is a cross sectional view of an image forming unit of an image forming apparatus according to the present invention.

In FIG. 2, image forming units 10Y, 10M, 10C, and 10K respectively form yellow, magenta, cyan, and black images. FIG. 3 is an enlarged view of one station of the image forming units.

A recording sheet stored in a cassette 1 is fed by a sheet feeding unit 2, and then reaches registration rollers 3. The recording sheet undergoes skew feeding correction, etc. by the registration rollers 3, and is then sent to a transfer belt 4 at appropriate timing. Meanwhile, latent images corresponding to the above described colors are formed on photosensitive drums 11Y, 11M, 11C, and 11K by image information signals supplied from a document reading apparatus (not shown) or an output device (not shown) of a computer.

On the other hand, the recording sheet sent out from the registration rollers 3 is electrostatically attracted onto the transfer belt 4, and is conveyed by the transfer belt 4 while passing under the image forming units 10Y, 10M, 10C, and 10K of different colors.

In the image forming units 10Y, 10M, 10C, and 10K, exposure light-emitting diode (LED) heads 12Y, 12M, 12C, and 12K, developing units 13Y, 13M, 13C, and 13K, and injection charging devices 14Y, 14M, 14C, and 14K are arranged around the photosensitive drums 11Y, 11M, 11C, and 11K. The electrophotographic process forms toner images of the respective colors on the surfaces of the photosensitive drums 11Y, 11M, 11C, and 11K. And, the toner images of the respective colors are successively transferred onto the recording sheet by an action of transfer units 5Y, 5M, 5C, and 5K at a transfer portion in which the transfer belt 4 and the photosensitive drums 11Y, 11M, 11C, and 11K are in close proximity.

A residual toner that has not been transferred to the recording sheet is scraped off from the surfaces of the photosensitive drums 11Y, 11M, 11C, and 11K by a cleaner 8.

Self stripping separates the recording sheet onto which the toner images of the four colors have been transferred from the transfer belt 4. The recording sheet is conveyed to a fixing unit 6. Heat and pressure applied in the fixing unit 6 fixes the toner images to the recording sheet. Then, the recording sheet is discharged onto a sheet discharge tray 7, thus the copying operation is completed.

Figure 4:
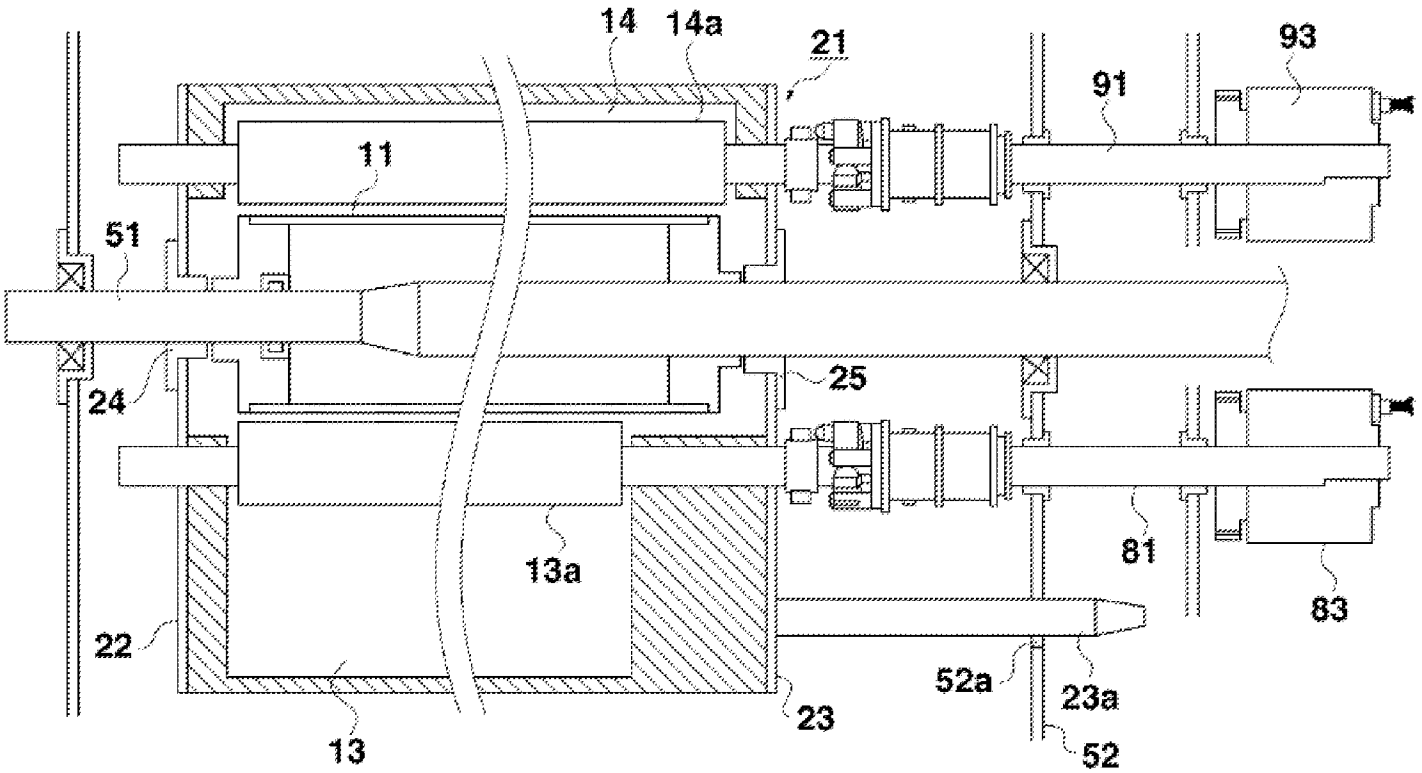
FIG. 4 is a plan sectional view of an image forming unit and a drive system of an image forming apparatus according to the present invention.

Next, a process cartridge 21 will be described with reference to FIGS. 3 and 4. FIG. 4 is a plan sectional view illustrating the process cartridge and the drive system thereof.

The process cartridge 21 is configured by the photosensitive drum 11, the developing unit 13, and the injection charging device 14, which are integrally supported by kit side plates 22 and 23 as shown in FIG. 4. The process cartridge 21 is detachable with respect to the apparatus main body in a longitudinal direction, and allows integral replacement or partial replacement/maintenance.

The photosensitive drum 11 is positioned not by the kit side plates 22 and 23, but by fitting into a drum shaft 51 when the photosensitive drum 11 is attached to the apparatus main body. In contrast, the developing unit 13 and the injection charging device 14 are fixed to the kit side plates 22 and 23. Bearing portions 24 and 25 of the kit side plates 22 and 23 are fitted with the drum shaft 51, and further, a pin 23*a* protruding from the kit side plate 23 is fitted with a short diameter portion of an elongated hole 52*a* of a main body side plate 52, so that positioning of the kit side plates 22 and 23, the developing unit 13, and the injection charging device 14 can be implemented.

A developing sleeve 13*a* of the developing unit 13 and an injection sleeve 14*a* of the injection charging device 14 are assembled to the kit side plates 22 and 23, with their distance to the bearing portions 24 and 25 respectively being adjusted in advance with high precision. As a result, the developing sleeve 13*a* and the injection sleeve 14*a* are positioned to the drum shaft 51 with high precision in a radial direction when the process cartridge 21 is attached to the apparatus main body. Positioning of the photosensitive drum 11 also is performed with respect to the drum shaft 51, so that a clearance (SD gap) between the surface of the photosensitive drum 11 and the developing sleeve 13*a* and the injection sleeve 14*a* is set with high precision.

Drive shafts 81 and 91 shown in FIG. 4 are shafts that respectively drive the developing sleeve 13*a* and the injection sleeve 14*a*, and they are arranged coaxially with respect to the developing sleeve 13*a* and the injection sleeve 14*a*, respectively. The drive shafts 81 and 91 are respectively provided with electromagnetic clutches 83 and 93, which can be rotated with a predetermined timing. Couplings are respectively attached to leading edges of the developing sleeves 13*a* and the injection sleeves 14*a* and leading edges of the drive shafts 81 and 91. The couplings respectively transmit drive force from the drive shafts 81 and 91 to the developing sleeve 13*a* and the injection sleeve 14*a*.

Figure 5:
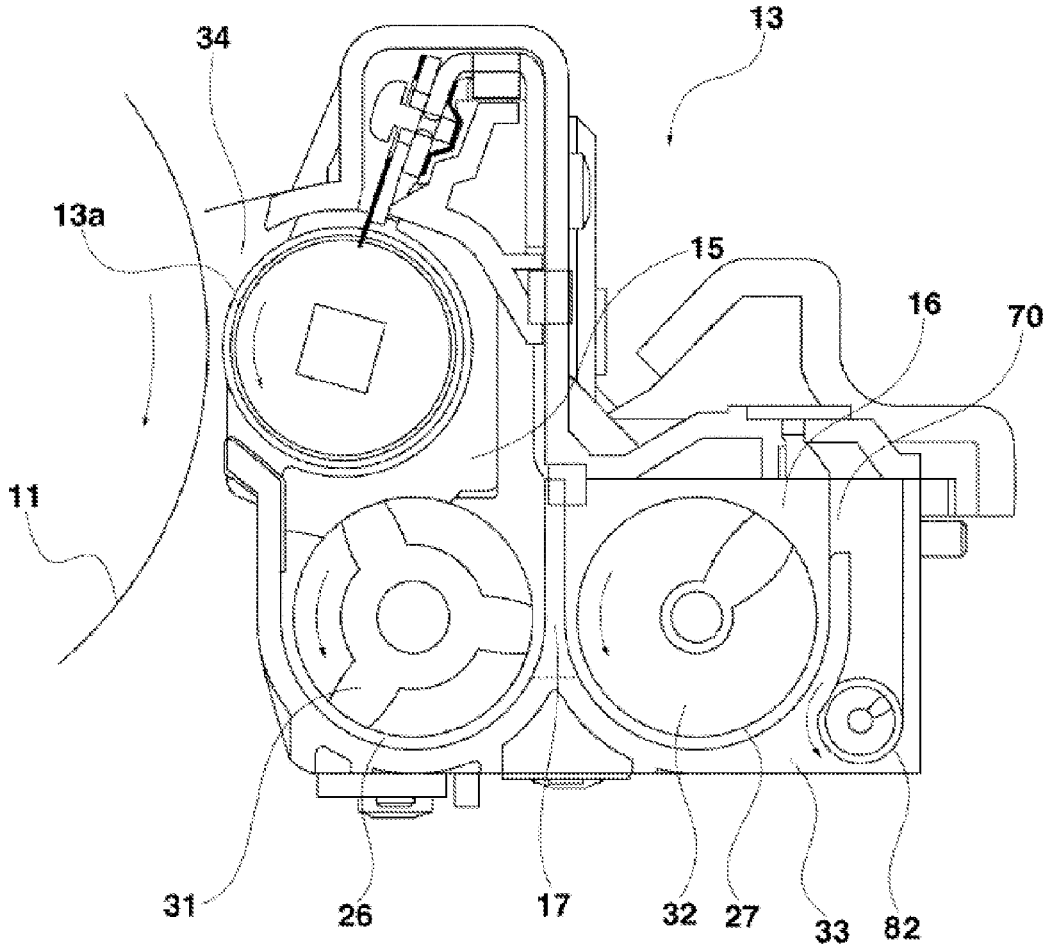
FIG. 5 is a cross sectional view illustrating a configuration of a developing unit according to the first exemplary embodiment of the present invention.

Next, the configuration of the developing unit 13 will be described in detail below with reference to FIGS. 5 and 6.

In the present exemplary embodiment, the developing unit 13 is equipped with a housing 33 that serves as a developer container for storing developer. In the housing 33, the developing sleeve 13*a* serving as a developer bearing member is rotatably arranged and located at an opening 34 facing the photosensitive drum 11 serving as an image bearing member. The housing 33 is equipped with a developing chamber 15 arranged near the developing sleeve 13*a*, and an agitating chamber 16 arranged far therefrom. A partition wall 17 divides the developing chamber 15 and the agitating chamber 16 from each other.

In a first conveyance path 26 formed in the developing chamber 15, a front side agitating shaft, that is a first developer agitating member 31, is arranged substantially parallel to an axis of the developing sleeve 13*a*. The first developer agitating member 31 conveys the developer in the developer container along the first conveyance path. In a second conveyance path 27 formed in the agitating chamber 16, a rear side agitating shaft is a second developer agitating member 32 that is arranged substantially parallel to the axis of the developing sleeve 13*a*. The two developer agitating members circulate the developer respectively via the developing chamber 15 and the agitating chamber 16 while agitating the developer. For example, the first and second developer agitating members 31 and 32 circulate the developer respectively via the first and second conveyance paths 26 and 27 while agitating the developer.

Figure 6:
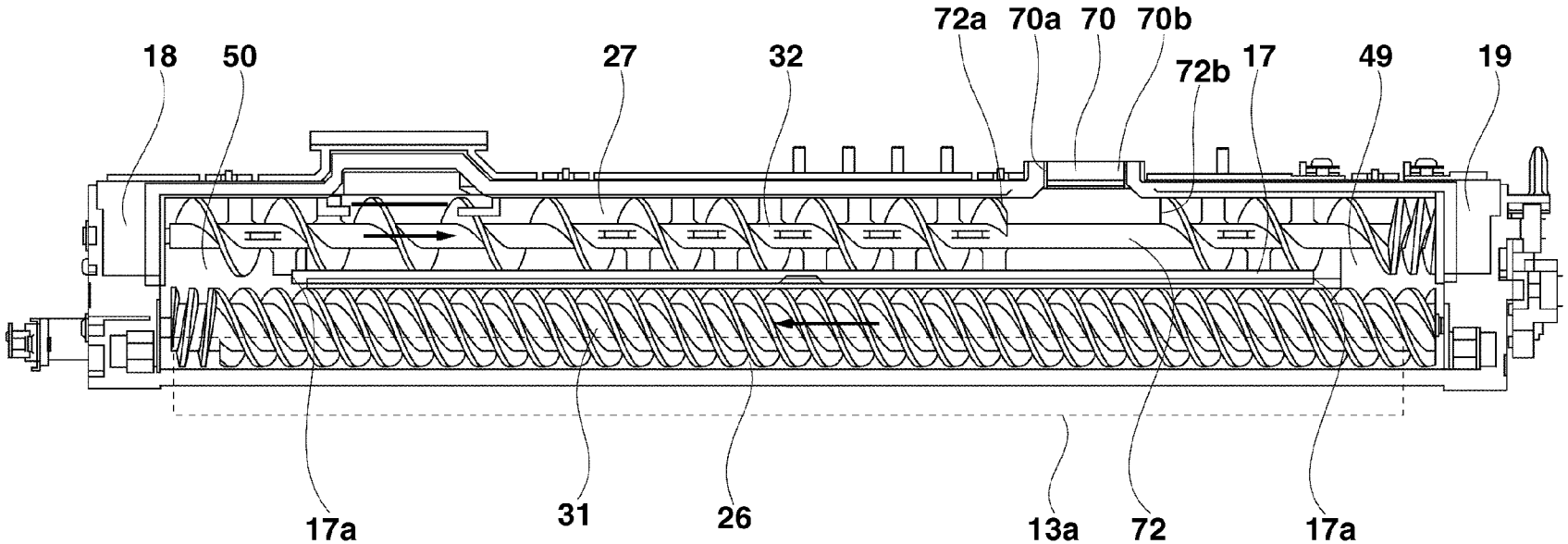
FIG. 6 is a cross sectional view, as seen from above, of the developing unit according to the first exemplary embodiment of the present invention.

As illustrated in FIG. 6, the partition wall 17 is formed for separating between the developing chamber 15 and the agitating chamber 16, that is, between the first conveyance path 26 and the second conveyance path 27. At both ends 17*a* of the partition wall 17, a first opening 50 and a second opening 49 are respectively formed between the both ends 17*a* and side walls 19 and 18 of the housing 33 which respectively face the both ends 17*a*. The first opening 50 serves to deliver the developer from the first conveyance path 26 to the second conveyance path 27, and the second opening 49 serves to deliver the developer from the second conveyance path 27 to the first conveyance path 26. Thus, the partition wall 17 is formed such that the first conveyance path 26 and the second conveyance path 27 communicate with each other only via the first opening 50 and the second opening 49 at the both ends 17*a* thereof. The other portions of the first conveyance path 26 and the second conveyance path 27 are blocked from each other and form developer circulation paths.

The developer is circulated in a direction indicated by arrows in FIG. 6 while being agitated. In the developing apparatus illustrated in FIG. 6, the first developer agitating member 31 is formed as a multi-thread screw member (which is a triple-thread screw member in the present exemplary embodiment), and the second developer agitating member 32 is formed as a single-thread screw member. As described above, the first developer agitating member 31 and the second developer agitating member 32 are respectively arranged in the first conveyance path 26 and the second conveyance path 27 to carry the developer in opposite directions. On a downstream side in a developer conveyance direction (the front side wall 19 side of the housing 33) from a center of the developer agitating member 32, and at a part of the side wall of the second conveyance path 27, there is provided a developer discharge port 70 for discharging an overflow portion of the developer conveyed by the second developer agitating member 32.

The developer discharged from the developer discharge port 70 is conveyed to a back surface side of the image forming apparatus (the side wall 18 side of the housing 33) by a developer discharge conveyance member 82, and is collected to a collection box provided in the image forming apparatus main body. Similar to the second developer agitating member 32, the developer discharge conveyance member 82 is formed as a single-thread screw member. In the second developer agitating member 32, a conveyance capacity of a region thereof including at least a facing portion facing the developer discharge port 70 is lower than a conveyance capacity of a region thereof adjacent to the above described region, or, the conveyance capacity of the above described region is zero.

In the present exemplary embodiment, a cutout portion 72, which is formed by removing a screw, is provided on the second developer agitating member 32 at the facing portion facing the developer discharge port 70.

In the present exemplary embodiment, while the screw is completely removed in the cutout portion 72. However, as another exemplary embodiment, the cutout portion 72 may adopt a configuration in which a screw outer diameter is made smaller than that of the other portion of the second developer agitating member 32. This reduces the developer agitating and conveyance capacity of the cutout portion 72.

As described above, the cutout portion 72 is provided at the position facing the developer discharge port 70, so that it is possible to reduce an amount of the developer agitated and conveyed by the second developer agitating member 23 to be discharged via the developer discharge port 70 due to splashing by the screw. Thus, it is possible to prevent the developer from being discharged due to splashing by the screw despite the fact that a height of the developer surface is lower than the developer discharge port 70. Accordingly, the developer within the developing apparatus can be maintained in an appropriate amount.

While the cutout portion 72 is provided in the present exemplary embodiment at a position facing the developer discharge port 70, a similar effect can be attained, according to a rotating speed and the screw configuration of the agitating member, by providing the cutout portion 72 on the upstream side in the developer conveyance direction of the position facing the developer discharge port 70. To reduce an excessive discharge due to splashing by the screw, it is effective to arrange an upstream side end surface 72*a* and a downstream side end surface 72*b* of the cutout portion 72 to be spaced apart respectively from an upstream side end surface 70*a* and a downstream side end surface 70*b* of the developer discharge port 70.

However, as a result of the provision of the cutout portion 72, the developer conveyance capacity is locally reduced at the portion, so that residence of developer is likely to occur halfway through the developer circulation. In particular, residence is likely to occur when the developer has undergone service deterioration to be reduced in fluidity, and when residence occurs, the circulation of the developer is hindered at the portion concerned. Thus, it is desirable for a width of the cutout portion 72 to be as small as possible within a range in which the discharge of the developer due to splashing is permissible. For example, in the present exemplary embodiment, the width of the developer discharge port 70 is 10 mm, whereas the width of the cutout portion 72 is 20 mm.

As described above, the amount of the developer discharged via the developer discharge port 70 due to the splashing by the screw varies depending upon a positional relationship between the upstream side end surface 70*a* of the developer discharge port 70 and the upstream side end surface 72*a* of the cutout portion 72. Further, the amount of the developer discharged via the developer discharge port 70 varies depending upon the positional relationship between the downstream side end surface 70*b* of the developer discharge port 70 and the downstream side end surface 72*b* of the cutout portion 72. Thus, if these positional relationships can be determined with high precision, it is possible to minimize the width of the cutout portion 72. Generally, positioning of the developer agitating member and the housing of the developing unit in the axial direction is performed in by providing abutment members such as E-shaped snap rings (E-shaped retainers) at both ends of the developer agitating member and causing them to abut on the housing and bearing members of the developer agitating member. In this case, to allow dimensional variation in production and a dimensional change due to thermal expansion in the housing and the developer agitating member, it is common practice to design them with a play of 1 mm or less between the abutment members and the housing or the like.

However, the relative position between the developer agitating member and the housing may vary within the range of the play described above. As a result, the relative position between the upstream side end surface 70*a* of the developer discharge port 70 and the upstream side end surface 72*a* of the cutout portion 72, and the relative position between the downstream side end surface 70*b* of the developer discharge port 70 and the downstream side end surface 72*b* of the cutout portion 72 also vary. Even if the play is gathered on one side, the above described relative positions may vary due to the dimensional variation in production and dimensional change as a result of thermal expansion. Due to this variation, the amount of the developer discharged from the developer discharge port 70 fluctuates, so that the amount of the developer in the developing apparatus and further the degree of degeneration of the developer become rather unstable, and a developed latent image may be unstable. In the present exemplary embodiment, a core of the second developer agitating member 32 is formed of a metal. The housing is formed of resin only, so that the second developer agitating member 32 and the housing differ from each other in coefficient of thermal expansion. Therefore, when thermal expansion occurs, the relative position between the discharge port provided in the housing and the cutout portion of the second developer agitating member 32 fluctuates. In the present exemplary embodiment, the coefficient of thermal expansion of the conveyance member is smaller than the coefficient of thermal expansion of the housing in which the discharge port is provided.

Figure 7:
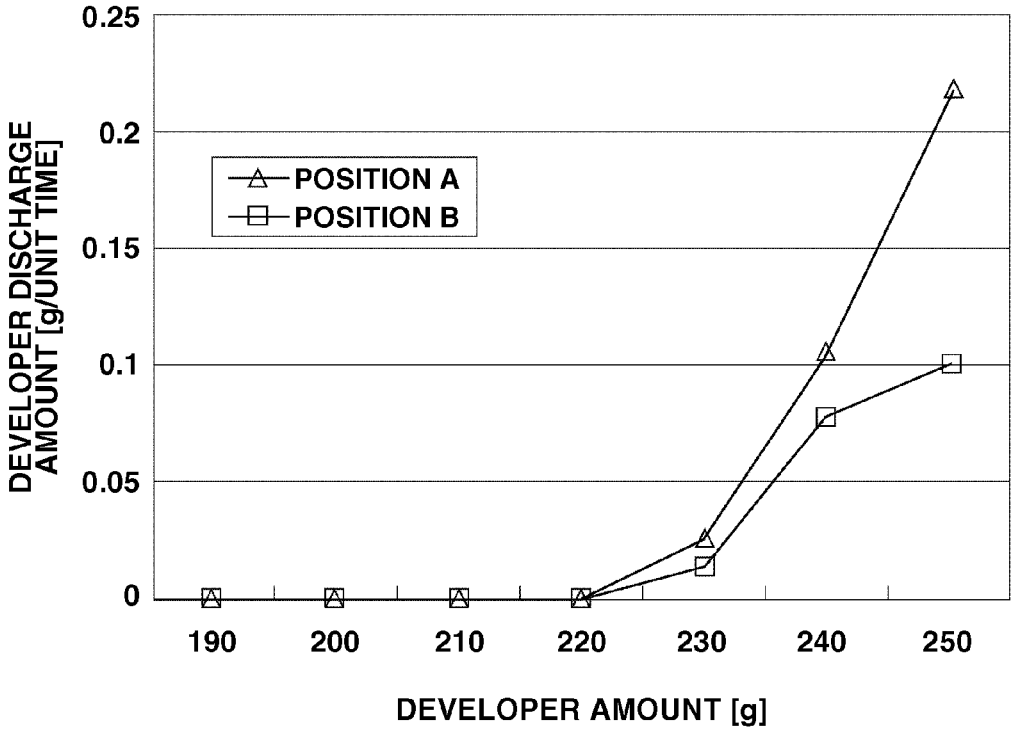
FIG. 7 is experiment results illustrating a relationship between a developer amount and an amount of developer discharged per unit time from a developer discharge port.

For example, results as shown in FIG. 7 were obtained in an experiment conducted by the inventor of the present invention. FIG. 7 illustrates a relationship between an amount of developer sealed in a developing apparatus provided with a developer discharge port 70 as in the present exemplary embodiment and an amount of developer discharged per unit time via the developer discharge port 70. Between a position A and a position B, there is a difference of 0.6 mm in a relative position between the developer agitating member and the housing. As compared with the case of the position A, in the case of the position B, the cutout portion 72 is provided still further on the upstream side in the developer conveyance direction. As can be seen from FIG. 7, in the case of the position A in which the screw portion of the developer agitating member is nearer to the developer discharge port 70 more developer is discharged due to a splashing effect of the screw. In this way, it will be understood that when there is a difference in the relative positions between the developer agitating member and the housing, there is a difference in developer discharge characteristics when the developer amount increases.

Figure 1:
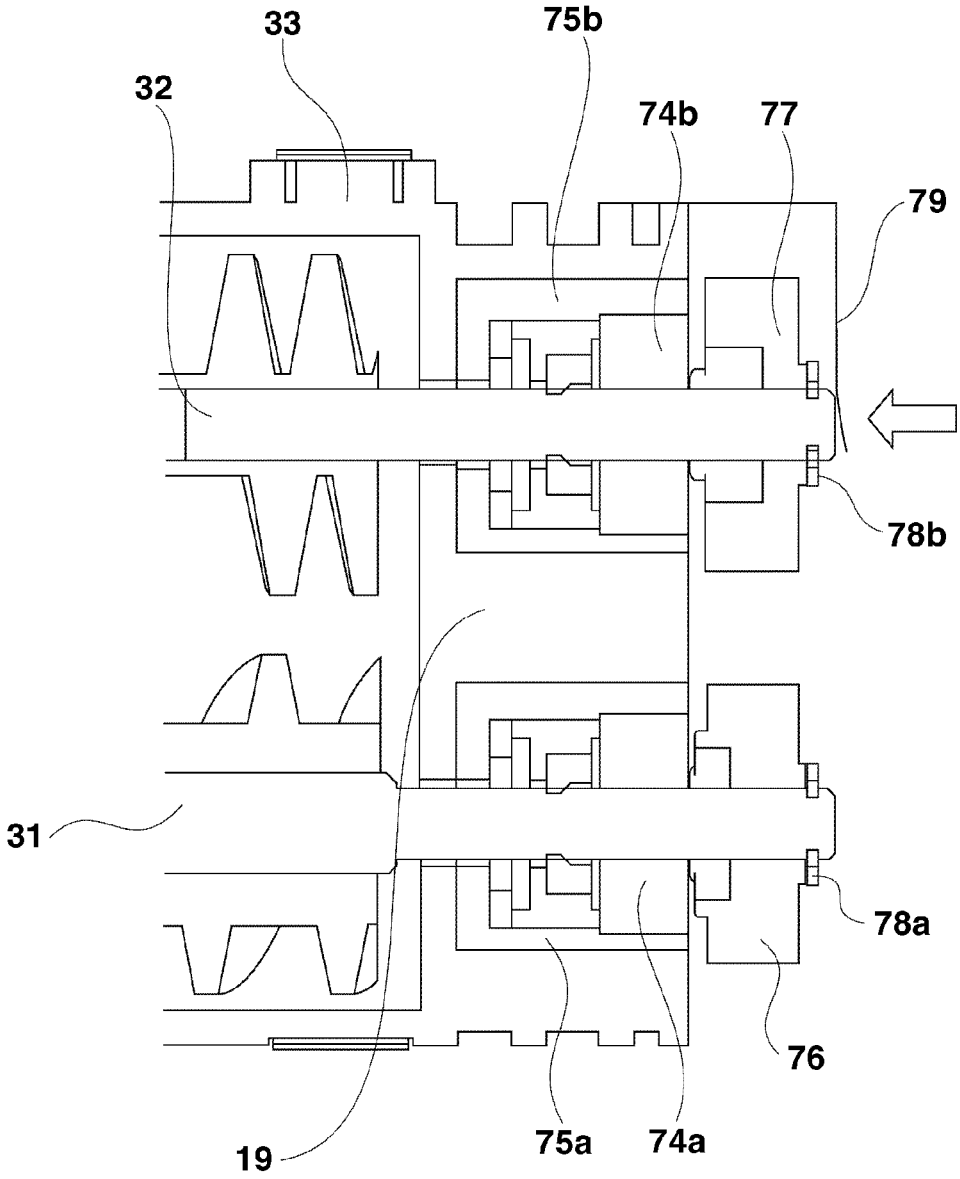
FIG. 1 is a cross sectional view illustrating an end portion configuration of an agitating member according to a first exemplary embodiment of the present invention.

In view of this, in the present exemplary embodiment, positioning in the axial direction is performed on the second developer agitating member 32 as shown in FIG. 1. FIG. 1 is an enlarged cross sectional view of an end portion of the housing 33 on the front side wall 19 side. In FIG. 1, the first developer agitating member 31 and the second developer agitating member 32 are respectively rotatably supported by bearing members 74*a* and 74*b*. The bearing members 74*a* and 74*b* are placed in positions by fitting with sealing units 75*a* and 75*b* for preventing leakage of the developer to the exterior of the housing 33. The sealing units 75*a* and 75*b* are placed in positions by fitting with hole portions provided at the end portion of the housing 33.

At the end portions of the first developer agitating member 31 and the second developer agitating member 32, there are respectively provided a first driven transmission member 76 and a second driven transmission member 77 for transmitting drive force to the first developer agitating member 31 and the second developer agitating member 32, respectively. Further, the drive force transmitted to the developing sleeve 13*a* from a drive shaft 81 is distributed and supplied via an idler gear (not shown).

The first driven transmission member 76 and the second driven transmission member 77 are fixed in the rotating direction with respect to the first developer agitating member 31 and the second developer agitating member 32. To achieve this, parallel pins are inserted into hole portions respectively formed in the shaft end portions of the first developer agitating member 31 and the second developer agitating member 32. The fixation in the rotating direction also may be effected by providing D-cut surfaces at the shaft end portions and fitting them with the driven transmission members. The first driven transmission member 76 and the second driven transmission member 77 also are fixed in the axial direction of the first developer agitating member 31 and the second developer agitating member 32 by members such as E-shaped snap rings or grip rings.

Further, on the outer side of the first driven transmission member 76 and the second driven transmission member 77, there are provided abutment members 78*a* and 78*b* for regulating the positions of the first developer agitating member 31 and the second developer agitating member 32 in the axial direction. In the present exemplary embodiment, E-shaped snap rings formed of iron are used as the abutment members.

An urging member 79 is provided on one side surface of the housing 33. The urging member 79 is a plate spring formed of a stainless steel (SUS) plate, and urges the end surface of the second developer agitating member 32 in a direction indicated by an arrow. Thus, the second developer agitating member 32 is placed in a position by abutting on the front side wall 19 of the housing 33 via the sealing unit 75*b*, the bearing member 74*b*, the second driven transmission member 77, and the abutment member 78*b*.

In the present exemplary embodiment, a positioning unit, which places the second developer agitating member 32 in the position in the axial direction by abutting on the housing, is formed by the sealing unit 75*b*, the bearing member 74*b*, the second driven transmission member 77, and the abutment member 78*b*. Further, the positioning unit is provided at one axial end of the second developer agitating member 32. The urging force of the urging member 79 is set to a sufficiently large force so that the second developer agitating member 32 may abut in the urging direction to be placed in the position even when the second developer agitating member 32 is driven. In the present exemplary embodiment, the urging force is set to 5 Newtons (N).

As described above, in the present exemplary embodiment, the positioning of the second developer agitating member 32 is implemented at the housing end portion nearer to the developer discharge port 70. More specifically, the developer discharge port 70 is provided to be situated nearer to the positioning unit side than to the central portion of the second developer agitating member 32 with respect to the axial direction of the second developer agitating member 32. Generally, dimensional variation in component production increases as a distance from a reference portion to an object portion increases. Further, dimensional variation due to thermal expansion increases as the distance from the reference portion increases.

Thus, as described in the present exemplary embodiment, position of the second developer agitating member 32 is determined at the housing end portion nearer to the developer discharge port 70. As compared with the case in which the position is determined at the other end of the housing 33, it is possible to determine the relative position between the cutout portion 72 of the second developer agitating member 32 and the housing with higher precision. More specifically, according to the present exemplary embodiment, the cutout portion 72 is provided in the second developer agitating member 32 to reduce the excessive discharge of the developer due to splashing by the screw, and the component dimensional variation in production and the dimensional variation due to thermal expansion are allowed, whereby it is possible to maintain stable developer discharge characteristics.

In the present exemplary embodiment, the housing 33 is provided with a plate spring formed of an SUS plate as the urging unit for the second developer agitating member 32. However, the urging member is not limited to this configuration. For example, it also is possible to provide a waved washer formed of a metal such as SUS between the abutment member of the second developer agitating member 32 on the side farther from the developer discharge port 70 and the abutted portion, and to cause the abutment portion on the side nearer to the developer discharge port 70 to abut on the abutted portion, thereby performing the positioning.

An effect of the present exemplary embodiment is the more enhanced the smaller the distance between the abutment portion to be positioned and the developer discharge port 70. Thus, it is desirable for the developer discharge port 70 to be nearer to the end portion of the housing 33. Thus, while in the present exemplary embodiment the developer discharge port 70 is provided on the inner side of a region in which the developing sleeve 13*a* can perform development (i.e., region allowing development), it is more desirable to provide the developer discharge port 70 on the outer side of the region allowing development. Here, the region allowing development denotes a region facing a maximum image forming region of the image bearing member.

Figure 8:
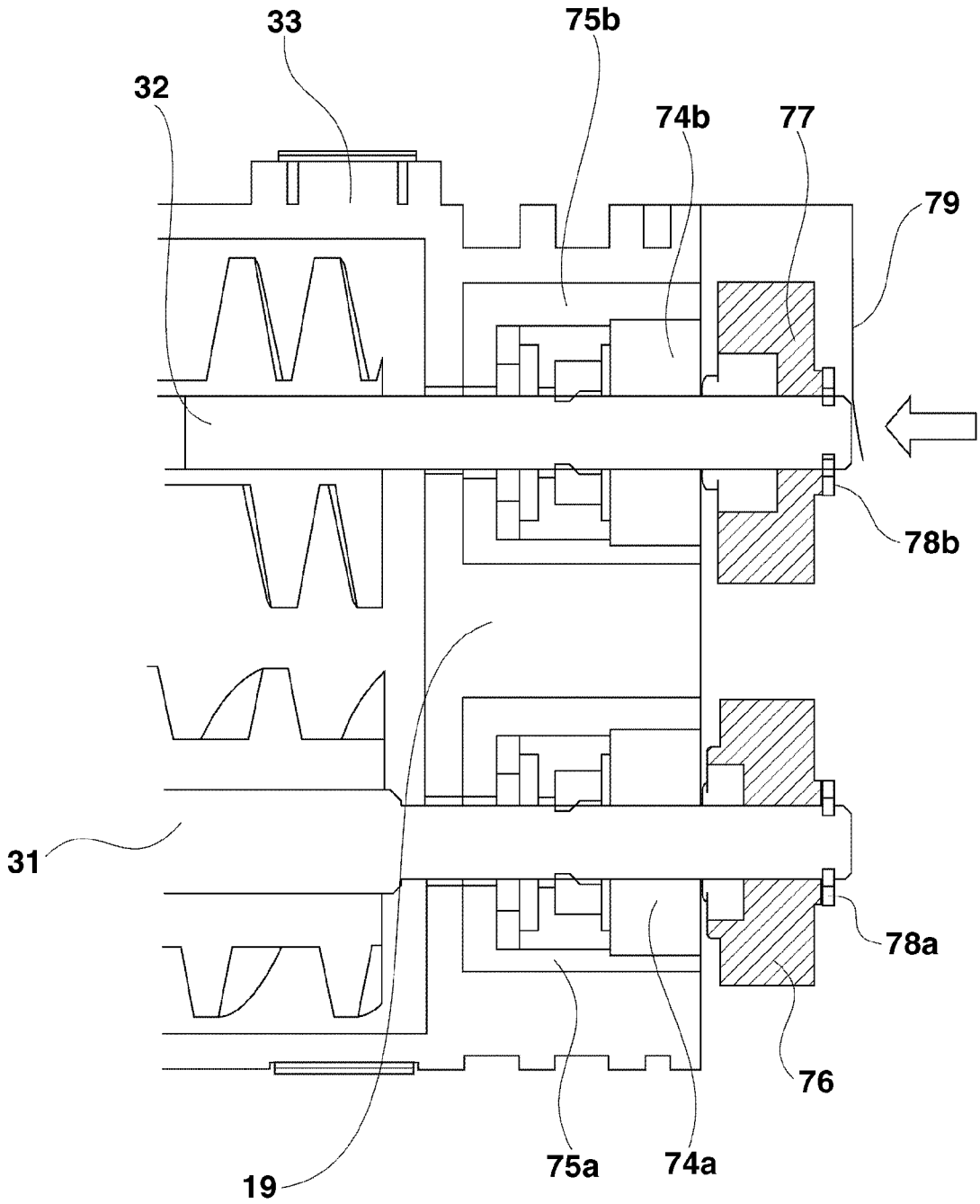
FIG. 8 is a cross sectional view illustrating an end portion configuration of an agitating member according to a second exemplary embodiment of the present invention.

FIG. 8 is an enlarged cross sectional view of a side end portion of the front side wall 19 of the housing 33 according to a second exemplary embodiment. Unless otherwise specified, the configuration of the present exemplary embodiment is similar to that of the first exemplary embodiment, so a detailed description thereof will be omitted. In the present exemplary embodiment, the first driven transmission member 76 and the second driven transmission member 77 are formed by helical gears. A twisting direction of the helical gear constituting the second driven transmission member 77 is set such that an axial direction component of the drive force input to the second driven transmission member 77 is in a direction indicated by an arrow in FIG. 8. Thus, in addition to the urging force of the urging member 79, an urging force also is provided by the component of the drive force, so that positioning by abutment is realized more reliably at the housing end portion nearer to the developer discharge port 70.

When the urging force due to the component of the drive force is sufficient, there is no need to provide the urging member 79. Further, in the present exemplary embodiment, the drive force input from the image forming apparatus main body to the developing sleeve 13*a* is distributed to the second driven transmission member 77. On the contrary, it also is possible to input the drive force from the image forming apparatus main body to the second driven transmission member 77 via the helical gear and distributes the drive force to the developing sleeve 13*a* or the first driven transmission member 76. In this case, a larger drive force is input to the second driven transmission member 77 to drive the first developer agitating member 31 and the developing sleeve 13*a* in addition to the second developer agitating member 32, so that the axial direction component of the drive force acting on the second driven transmission member 77 also becomes larger.

Figure 9:
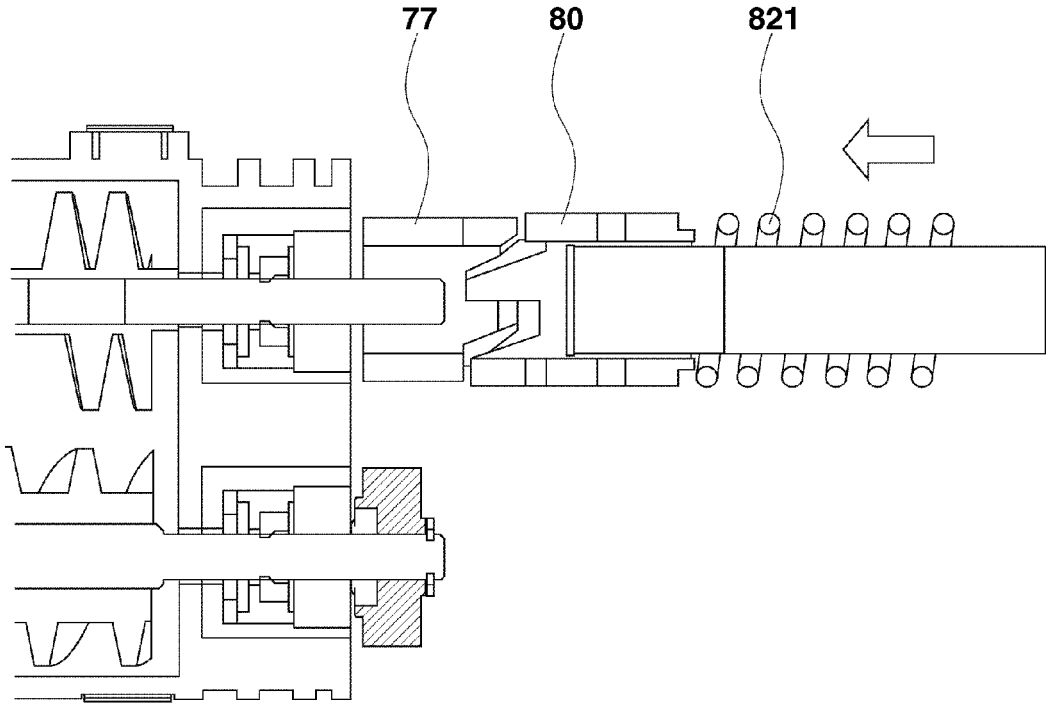
FIG. 9 is a cross sectional view illustrating an end portion configuration of an agitating member according to a third exemplary embodiment of the present invention.

FIG. 9 is an enlarged cross sectional view of a side end portion of the front side wall 19 of the housing 33 according to a third exemplary embodiment. Unless otherwise specified, the configuration of the present exemplary embodiment is similar to that of the first exemplary embodiment, so a detailed description thereof will be omitted. In the present exemplary embodiment, the second driven transmission member 77 is formed by a joint (coupling). The second driven transmission member 77 is fixed in the rotating direction with respect to the second developer agitating member 32 via a parallel pin inserted into a hole portion formed at a shaft end portion of the second developer agitating member 32. The fixation in the rotating direction also may be effected by providing a D-cut surface at the shaft end portion and fitting it with the driven transmission member. The second driven transmission member 77 also is fixed in the axial direction of the second developer agitating member 32 by a member such as an E-shaped snap ring or a grip ring. The drive force is transmitted to the second driven transmission member 77 from the image forming apparatus main body via an agitating drive transmission member 80. In order to be reliably engaged with the second driven transmission member 77, the agitating drive transmission member 80 is pressurized in a direction indicated by an arrow in FIG. 9 by an urging spring 821. Thus, urging force in the direction of the arrow in FIG. 9 is applied to the second driven transmission member 77 via the agitating drive transmission member 80, so that the second developer urging member 32 abuts on the end portion of the housing nearer to the developer discharge port 70, and the position thereof is determined.

As described above, according to the present invention, excessive discharge of the developer due to splashing by the screw can be reduced. Further, if there is a difference in thermal deformation amount between the developer container and the conveyance member, it is possible to suppress fluctuation in the developer discharge by a change in the relative position between the discharge port and the cutout portion of the conveyance member due to a dimensional change caused by thermal expansion.

While the present invention has been described with reference to exemplary embodiments, it is to be understood that the invention is not limited to the disclosed exemplary embodiments. The scope of the following claims is to be accorded the broadest interpretation to encompass all modifications, equivalent structures, and functions.

This application claims priority from Japanese Patent Application No. 2009-168987 filed Jul. 17, 2009, which is hereby incorporated by reference herein in its entirety.

What is claimed is:

1. A developing apparatus, comprising:

a developer container configured to store a developer;

a conveyance member provided with a helical blade and configured to convey the developer in the developer container;

a discharge port configured to discharge the developer in the developer container, wherein the discharge port is provided on the developer container at a position that is on one end side from a central portion of the conveyance member with respect to an axial direction of the conveyance member and that faces the conveyance member, wherein the conveyance member has a region in which the helical blade is not formed or an outer diameter of the helical blade is small at least at a portion facing the discharge port; and a positioning member unmovable in an axial direction of the conveyance member with respect to the conveyance member and configured to position the conveyance member in the axial direction with respect to the developer container by being abutted on the one end side of the developer container at least when the conveyance member is being driven.

2. The developing apparatus according to claim 1, wherein a driven transmission unit is configured to transmit drive force from an image forming apparatus main body to the conveyance member, and is configured to determine a position of the conveyance member in the axial direction by urging the conveyance member with a force acting on the conveyance member in the axial direction by driving of the driven transmission unit.

3. The developing apparatus according to claim 1, wherein the discharge port is provided on an outer side of a region allowing development with respect to the axial direction of a developer bearing member.

4. The developing apparatus according to claim 1, wherein drive force input to the conveyance member is transmitted to a developer bearing member via a drive transmission member.

* * * * *